United States Patent [19]

Monsheimer et al.

[11] 4,273,876

[45] Jun. 16, 1981

[54] ENZYMATIC BATING METHOD

[75] Inventors: Rolf Monsheimer, Darmstadt-Eherstadt; Ernst Pfleiderer, Darmstadt-Arheilgen, both of Fed. Rep. of Germany

[73] Assignee: Röhm GmbH, Darmstadt, Fed. Rep. of Germany

[21] Appl. No.: 104,832

[22] Filed: Dec. 18, 1979

[30] Foreign Application Priority Data

Dec. 27, 1978 [DE] Fed. Rep. of Germany ..... 2856320

[51] Int. Cl.[3] ..... C14C 1/00

[52] U.S. Cl. ..... 435/265; 8/94.18

[58] Field of Search ..... 435/202–204, 435/265; 8/94.14, 94.16, 94.15, 94.17, 94.18

[56] References Cited

U.S. PATENT DOCUMENTS

| | | | |
|---|---|---|---|
| 2,363,646 | 11/1944 | Conquest et al. | 435/265 |
| 3,133,002 | 5/1964 | Grimm | 435/265 |
| 3,288,683 | 11/1966 | Tanaka et al. | 435/203 |
| 4,022,666 | 5/1977 | Mitsugi et al. | 435/202 |

FOREIGN PATENT DOCUMENTS

| | | | |
|---|---|---|---|
| 585232 | 10/1959 | Canada | 435/265 |
| 200519 | 6/1907 | Fed. Rep. of Germany . | |
| 17399 | 8/1956 | Fed. Rep. of Germany . | |
| 976928 | 8/1964 | Fed. Rep. of Germany . | |
| 1230169 | 12/1966 | Fed. Rep. of Germany . | |
| 1800891 | 9/1970 | Fed. Rep. of Germany . | |
| 795850 | 5/1958 | United Kingdom | 435/265 |

OTHER PUBLICATIONS

Ullmann's Encyclopedia of Technical Chemistry, 4th Ed., vol. 10, p. 517 (1975).

Ullmann's Encyclopedia of Technical Chemistry, 4th Ed., vol. 16, p. 120 (1975).

Stubbings, "Practical Bating, etc."*J. Am. Leath. Chem. Assoc.,* p. 306 (1957).

*Primary Examiner*—Thomas G. Wyse

*Attorney, Agent, or Firm*—Curtis, Morris & Safford

[57] ABSTRACT

What is disclosed is a method for the enzymatic bating of pelts with simultaneous removal of scud, which method comprises bating said pelts in the acid pH range in the presence of an amylase and a protease.

1 Claim, No Drawings

ENZYMATIC BATING METHOD

The present invention relates to enzymatic methods for bating dehaired skins and hides in the presence of both an amylase and a protease.

It is known that in order to prepare leathers having a certain degree of softness and pliable feel and exhibiting a high-quality grain, the dehaired pelts must be subjected, after liming and de-liming, to an additional enzymatic process known as bating. The technological purpose of this step, in addition to further cleaning the skin of hair, fat and epidermis residues, is to bring about de-swelling, on the one hand, and loosening and conditioning of the entire skin fiber texture, on the other. As early as 1907, O. Roehm introduced an enzymatic bating process using pancreatic enzymes with the addition of ammonium salts (German Pat. No. 200,519). The ammonium salts also exert a de-liming effect and, together with liberated ammonia, form a weakly alkaline buffer system which stabilizes the pH range that is optimal for tryptic enzymes. Subsequently, proteases obtained from fungi and bacteria have been used for bating to an increasing extent. Most commercially available bating preparations have comparable compositions and differ from one another mainly by their enzyme- or ammonium salt content, by the type of enzyme, and in part also by the wetting agents added.

An enzymatic de-hairing of skins and hides with proteases with the addition of carbohydrases at pH 5.5–10, followed by after-treatment at pH 3.0–5.5 with proteolytic enzymes prepared from microorganisms, has been proposed in the prior art, a method wherein the proteases may be combined with carbohydrases with a view to obtaining an optimum effect. According to this art, the carbohydrases used in this method are oligases, i.e. enzymes which split simple glycosides and oligosaccharides (cf. "Handbuch der Enzymologie" [Handbook of Enzymology], ed. by F. F. Nord and R. Weidenhagen, Akademische Verlagsgesellschaft, Leipzig, 1940, p. 514 ff). From a modern point of view, the success of the technological steps carried out in the beamhouse after liming is to be judged by whether the desired loosening of scud is achieved.

Still other prior art proposes a method for softening or bating skins or hides or for after-bating pretanned skin material with the aid of proteolytic enzymes at pH 3–5 under non-swelling conditions, a process characterized by the use of papain as the protease.

It has now been found that in an enzymatic bating process carried out in the acid pH range, a completely satisfactory bating effect combined with an excellent loosening of scud is achieved if amylases and proteases are simultaneously used as the enzymes, and, specifically, by using amylases having a certain concomitant proteolytic activity. In accordance with the present invention the term "acid pH range" is generally understood to mean the range from pH 2 to pH 7.5, and particularly the range from pH 3 to pH 6.

The use of amylases in combination with acidic proteases is particularly preferred.

The amylases suitable for the purposes of the present invention are to be understood as those enzymes which catalyze the hydrolysis of an $\alpha$-1→4 glycosidic linkage in polysaccharides, and especially those which possess a concomitant proteolytic activity, particularly $\alpha$-amylases [cf. Fischer and Stein, "The Enzymes," ed. by P. D. Boyer et al., Vol. IV, pages 313–343, Academic Press, 2nd edition, (1960)]. With regard to starch decomposition, the optimum pH range of the suitable amylases is generally between 5 and 6 when working in the temperature range between 20° C. and 40° C. The optimum pH with respect to starch hydrolysis is frequently found to be markedly dependent on the temperature; i.e. as the temperature increases, the optimum pH values are displaced toward neutrality, with the enzyme activity showing a decreasing trend. On the other hand, the activity also decreases with decreasing pH.

The amylases which may be used in accordance with the invention are of animal, plant, or microbiological origin. It is thus possible to use pancreatic amylases, bacterial amylases, and fungal amylases.

It is assumed that the amylases contribute to the process by catalyzing the cleavage of glycosidic linkages present in the skin material.

The $\alpha$-amylases particularly suitable for the present process may be isolated, for example, from *Bacillus* species such as *Bacillus subtilis, Bacillus coagulans, Bacillus mesentericus,* or *Bacillus stearthermophilus,* from fungi, e.g. Aspergillus species such as *Aspergillus oryzae* (Taka-amylase), or *Aspergillus candidus,* and also from Pseudomonas species such as *Pseudomonas saccharophila.* Moreover, the isolation of $\alpha$-amylase from malt is also possible.

The acid proteases which come into question for use in combination with the amylases in accordance with the present invention include animal proteases such as pepsin and trypsin, plant proteases such as papain, and proteases of microbiological origin, above all fungal proteases such as those isolated from Aspergillus species (*Aspergillus saitoi, Aspergillus oryzae, Aspergillus niger*), from Penicillium species such as *Penicillium roqueforti,* or from *Rhiz. chinenensis* or *Mucor pusillus,* with the optimum activity range of these proteases (against hemoglobin) being between pH 2 and 7.

The use of proteolytic enzymes whose optimum activity against hemoglobin occurs at pH values of less than 5.5 is particularly preferred. It has been found particularly advantageous to combine acid fungal proteases with amylases which can be used in accordance with the present invention.

For using the aforementioned enzymes, prior-art methods in which acid proteases are used for bating can serve as a model.

The temperatures thus generally range between room temperature and about 50° C. The enzyme preparations may contain the usual additives such as salts—particularly ammonium sulfate, sodium sulfate and sodium chloride—in addition to agents commonly used for adjusting the desired pH. The duration of treatment depends primarily on the substrate. Thus in the case of "wet blues" the duration is of the order of 14 hours; for cattle hides and calf hides a much shorter treatment period—e.g. generally between 2 and 4 hours—is sufficient. The dehaired pelts softened and limed in the usual manner are subjected to mechanical operations such as fleshing and splitting, and are then de-limed in the usual manner in the vat, mixer, tanning machine, paddle and the like.

In the preparation of chrome leathers, the acid bating operation is most simply combined with the pickling required for adjusting the acidity. To prevent acid swelling, the operation should be carried out either with a sodium chloride buffer or with so-called non-swelling acids such as naphthalene-sulfonic acid, naphtholsulfonic acid, sulfophthalic acid and the like.

When working in a tanning vat, an expedient mode of operation consists in first introducing 50 to 100 weight percent of water—calculated on the weight of the pelts—at an inlet temperature of about 23°-25° C. into the vat. The pelts are then added. When working without non-swelling acids, 5-10 weight percent of sodium chloride is added and agitation is carried out for about 20 minutes. The enzyme product is then added and the pH adjusted through the addition of acids. Acids which may be added include, for example, formic acid, acetic acid, hydrochloric acid, and sulfuric acid. The amount added should be such that the pH of the liquor does not fall substantially below 4.0-4.5. To achieve this, between 0.5 and 1 weight percent of formic acid (technical, 85%) is needed, depending on the alkali content and thickness of the pelts.

The amount of enzyme is governed, among other things, by the fact of whether the operation is carried out as a brief process lasting for a few hours or as a process carried out e.g. overnight. The amount of enzyme required for brief processes is 3 to 4 times that required for long-time processes. In general, between 0.01 and 0.2 weight percent, preferably between 0.02 and 0.08 weight percent (calculated on the weight of the pelt), of an enzyme product containing 800 to 2500 Loehlein-Volhard units (cf. definitions below) is required.

At the end of the bating process, the pelt is present in a scud-free, degraded condition. The acidity required for chrome-tanning can be obtained in the same bath by further addition of acid. The subsequent chrome tanning step is also carried out in the same bath.

Whereas the effect of bating agents comprising pancreatic enzymes, like those mentioned in the introduction and which are used in the neutral or weakly alkaline pH range, consists mainly in removing dirt and scud from the grain, acid bating agents also bring about a loosening of the fiber texture, which is reflected in a softer feel of the leather.

Physical tests of tensile strength and elongation have shown that the values are improved by 15-20% as compared to conventional bating processes.

Hence, with the use of combinations of proteolytic and amylase-containing enzymes used in the acid pH range it is possible to dispense with the re-liming (Example 4) which is frequently carried out in practice. When these combinations are used during the depickling of pickled hides (Example 3), the creases which often develop during transportation are eliminated. Since pickled hides are frequently prepared with only a brief liming operation, such pickled hides are often insufficiently free of scud. The loosening of scud can be considerably improved by the use of an acid bate of the type described above. This makes it possible to use these pelts for the preparation of aniline leathers of a natural color, a possibility which does not exist without adequate loosening of the scud.

So-called "wet blues" (Example 5) can also be enzyme-treated in the chrome-tanned state with combinations of amylases and proteases. The prerequisite for this treatment is that the chromium salts not fixed to the fibers either be bound by the addition of so-called masking agents (formate, acetate, sulfite, etc.) or removed from the solution by washing processes. This pretreatment is necessary in order to prevent inhibition of the proteolytic enzymes.

Since the shrinkage temperature of "wet blues" is higher than that of pelts, temperatures of about 40° C. may be used during the practical application of the enzyme treatment. After the preparatory operations, the pH of the treatment bath is between 4 and 4.5, which is also within the optimum activity range of the enzymes. For the aforementioned reason an adjustment of the pH during the processing of "wet blues" is not required. In the case of "wet blues", the treatment should last overnight. At the end of the enzyme treatment the leathers are in a soft, degraded condition. This is reflected by the presence of a film of protein hydrolyzate on both the grain and flesh side.

The thumb pressure test may be carried out as a practical test for bating. As a result of the enzyme treatment, creases can be eliminated. More even colorings are obtained. The tensile strength and elongation values, as measured in physical tests, are improved. "Wet blues" that are impermeable to air prior to enzyme treatment become permeable to air after enzyme treatment carried out in accordance with the present invention. The best effects are obtained at a mean $Cr_2O_3$ content of 1-2 percent by weight calculated on the pelt weight. Usually the processing of skins and hide prior to bating comprises trimming, soaking, liming, unhairing and fleshing. Liming effects swelling of the fibers and separating the fibrils. It is this swollen, drained state of the starting materials (pelts) that the weights given in the examples are based on (unless stated otherwise).

The proteolytic activity of the enzymes is conveniently determined by the so-called Loehlein-Volhard method ["Die Loehlein-Volhard'sche Methode zur Bestimmung der proteolytischen Aktivitaet", "Gerbereitechnisches Taschenbuch", Dresden-Leipzig, (1955)] and is given or determined in terms of "LVU" (Loehlein-Volhard units). One LVU is defined as that amount of enzyme which digests 1.725 mg of casein under the specific conditions of the method employed. To determine the activity of the enzymes active in the acid range—a determination derived from Anson's method [M. L. Anson, J. Gen. Physiol. 22, 79 (1939)—the following considerations apply: The units are denoted as "protease units (hemoglobin)"$=U_{Hb}$. One $U_{Hb}$ corresponds to the amount of enzyme which catalyzes the release from hemoglobin of fractions soluble in trichloroacetic acid equivalent to 1 mole of tyrosine per minute at 37° C. (measured at 280 nm) 1 $mU_{Hb}=10^{-3}U_{Hb}$. The activity of the $\alpha$-amylases according to the present invention can be determined by the method of Sandstedt, Kneen and Blish [Cereal Chem. 16, 172 (1939)] and Technical Bulletin No. 1024, U.S. Dept. of Agriculture, with the use of starch as the substrate. In this method 1 amylase unit (1 SKB unit) is defined as the amount of enzyme which is capable, at 30° C. and under the indicated reaction conditions, of dextrinating 1 g of soluble starch in 1 hour.

In addition, Willstaetter's method is used for determining the activity of pancreatic amylase [Hoppe-Seylers Z. Physiol. Chem. 126, 143 (1923)]. In this method, one Willstaetter amylase unit is defined as 100 times the amount of enzyme which splits the starch under the indicated test conditions at a rate such that the monomolecular reaction constant is equal to 0.01.

A better understanding of the present invention and of its many advantages will be had from the following examples, given by way of illustration.

EXAMPLE 1

100 kg of cattle pelts are de-limed in a vat and are then subjected to bating with 100.0 weight percent of water of 25° C. inlet temperature, 0.025 weight percent of pancreatic amylase containing 42 Willstaetter amylase units/g and 2500 LVU, and 0.9 weight percent of ammonium sulfate.

After an operating time of 20 minutes, the pH is adjusted to 5.0 with so-called non-swelling acids such as sulfophthalic acid, naphthalenesulfonic acid, naphthol-sulfonic acid. After agitating for 3 hours, the pelts are free of scud. The pickling can be carried out in the same liquor by adjusting the pH of the liquor to 3.5 with the aforementioned non-swelling acids. The above percentages refer to the weight of the pelt.

EXAMPLE 2

100 kg of calf pelts are de-limed in a tanning machine and then subjected to bating by first agitating for 20 minutes with 60.0 weight percent of water of 25° C. inlet temperature, calculated on the pelt weight, 5.0 weight percent of sodium chloride, 0.025 weight percent of amylase prepared from *Bacillus subtilis* and containing 5000 SKB units and 850 LVU, 0.05 weight percent of fungal protease prepared from *Aspergillus parasiticus* and containing 1800 LVU, and 0.9 weight percent of sodium sulfate.

The pH is adjusted to 5.0 by addition of 0.8 weight percent of technical formic acid (85%) diluted 1:10, and agitation is carried out for 2 hours. After this time the pelts are free of scud and exhibit the characteristic bating aspects such as permeability to air and persistence of the indentation made in the thumb-pressure test. For pickling, the acidity can now be further adjusted in the same liquor by addition of technical sulfuric acid diluted 1:10.

EXAMPLE 3

100 kg of pickled sheep pelts are first depickled in a vat with 200.0 weight percent of water of 25° C. initial temperature (percentages calculated on drained weight), 12.0 weight percent of sodium chloride, and 1.5 weight percent of sodium bicarbonate.

Before the pelts are introduced, it must be ensured that the water and sodium chloride are thoroughly mixed, in order to prevent acid swelling. After an operating time of 1 hour, a pH of 5.0 is established in the liquor. For bating, 0.0125 weight percent of amylase prepared from *Aspergillus oryzae* and containing 4700 SKB units and 900 LVU and 0.019 weight percent of bacterial protease prepared from *Bacillus subtilis* and containing 850 LVU are added and agitation is carried out for 1 hour. The pelts remain in the vat overnight. During the night, agitation is carried out several times for 10 minutes. On the following morning agitation is carried out for 20 minutes. The pelts are free of scud, are permeable to air and no longer exhibit creases.

EXAMPLE 4

100 kg of split pelts are de-limed and washed in a mixer in the usual manner. They are then subjected to bating as follows:

70.0 weight percent of water of 25° C. inlet temperature, 0.02 weight percent of pancreatic amylase containing 42 Willstaetter units and 750 LVU, 0.02 weight percent of bacterial protease prepared from *Bacillus subtilis* and containing 900 LVU, and 0.9 weight percent of sodium sulfate.

After agitating for 30 minutes, the pH of the liquor is adjusted to 5.0 with naphthalenesulfonic acid. Agitation is carried out for a total of 2 hours. The pelts are left in the mixer overnight and are agitated 3 times for 10 minutes each. The total duration of treatment is 14 hours. After this time the pelt is de-swelled and degraded and exhibits the characteristic bating differences. The pelt is then pickled and tanned in the same liquor. The above percentages refer to the pelt weight.

EXAMPLE 5

100 kg of "wet blues" from lamb pelts are first agitated in the vat for 60 minutes with 100.0 weight percent of water, 35° C., and 1.0 weight percent of sodium sulfate.

They are then washed twice with 100 weight percent of water of 35° C. The object of these measures is to remove the non-fixed chrome tanning agent and to adjust the pH to the optimum value required for the enzyme treatment, which should be pH 5.0. Chrome tanning agent that has not been washed out causes inhibition of the enzyme. The enzyme treatment is carried out with 100.0 weight percent of water, 35° C., 0.6 weight percent of amylase prepared from *Bacillus subtilis* and containing 5000 SKB units and 1800 LVU, and 0.9 weight percent of sodium sulfate.

First, agitation is carried out for 2 hours. The leathers remain in the vat overnight. During this period agitation is carried out several times for 20 minutes. The duration of treatment is 14 hours. Thereupon the liquor is discharged and the skins are washed and tanned in the usual manner. The above percentages refer to the pelt weight. At the end of the enzyme treatment, the leathers exhibit the characteristic bating features such as slippery grain, permeability to air, and persistence of the indentation made in the thumb pressure test.

What is claimed is:

1. A method for the enzymatic bating of dehaired pelts with simultaneous removal of scud, which method comprises bating said pelts at a pH between 3 and 6 in the presence of an acid protease and of an amylase having concomitant proteolytic activity and an optimum hydrolytic activity against polysaccharides, with splitting of the $\alpha$-1$\rightarrow$4 glycosidic linkage, at a pH below 7.

* * * * *